US011633029B2

(12) United States Patent
Soulard et al.

(10) Patent No.: US 11,633,029 B2
(45) Date of Patent: Apr. 25, 2023

(54) FLUID PRODUCT RESERVOIR

(71) Applicant: SHISEIDO INTERNATIONAL FRANCE, Paris (FR)

(72) Inventors: Fabrice Soulard, Fay Aux Loges (FR); Bruno Simon, Boulay-les-Barres (FR); Philippe Peixoto, Fay Aux Loges (FR)

(73) Assignee: SHISEIDO INTERNATIONAL FRANCE, Paris (FR)

( * ) Notice: Subject to any disclaimer, the term of this patent is extended or adjusted under 35 U.S.C. 154(b) by 0 days.

(21) Appl. No.: 17/425,742

(22) PCT Filed: Jan. 27, 2020

(86) PCT No.: PCT/FR2020/050121
§ 371 (c)(1),
(2) Date: Jul. 26, 2021

(87) PCT Pub. No.: WO2020/157421
PCT Pub. Date: Aug. 6, 2020

(65) Prior Publication Data

US 2022/0167724 A1 Jun. 2, 2022

(30) Foreign Application Priority Data

Jan. 28, 2019 (FR) ..... 1900745

(51) Int. Cl.
*A45D 34/04* (2006.01)
*B05B 15/37* (2018.01)
(Continued)

(52) U.S. Cl.
CPC ..... *A45D 34/04* (2013.01); *B05B 11/0044* (2018.08); *B05B 11/0097* (2013.01);
(Continued)

(58) Field of Classification Search
CPC ..... A45D 34/14; A45D 2034/007; A45D 2200/053; A45D 34/00; B05B 11/00412;
(Continued)

(56) References Cited

U.S. PATENT DOCUMENTS 5,465,864 A 11/1995 Mcclean

FOREIGN PATENT DOCUMENTS

EP 0823288 A1 2/1998
JP 01226557 A 9/1989
(Continued)

OTHER PUBLICATIONS

Preliminary international search report for application PCT/FR2020/050121 dated Feb. 9, 2021.
(Continued)

*Primary Examiner* — Vishal Pancholi
(74) *Attorney, Agent, or Firm* — Sughrue Mion, PLLC

(57) ABSTRACT

Fluid product reservoir having a neck defining an opening, the neck having an upper annular edge defining an outer ridge and an inner ridge, the opening being defined by an inner wall connected to the upper annular edge by the inner ridge. At least one cutout is provided at the upper annular edge, this cutout extending on the inner wall, interrupting the inner ridge, but does not extend as far as the outer ridge, such that the upper annular edge is continuous over its entire periphery, including at the cutout, this cutout further forming a base defining a ridge with the inner wall of the opening.

9 Claims, 4 Drawing Sheets

Figure 1:
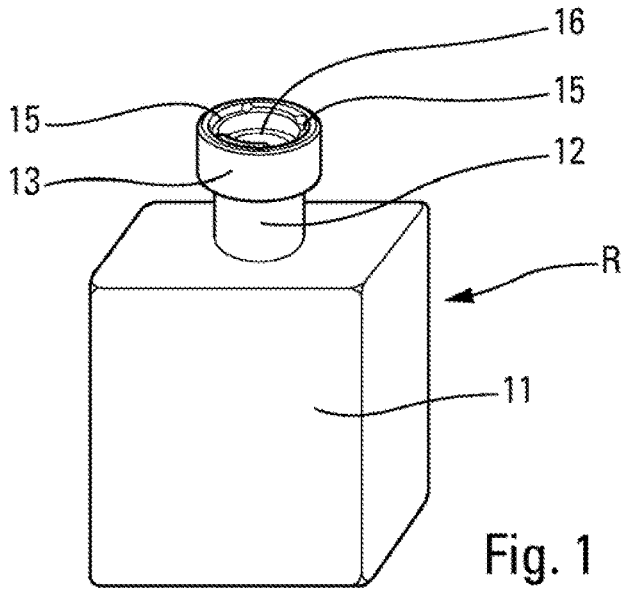

(51) Int. Cl.
*B05B 11/00* (2023.01)
*A45D 34/00* (2006.01)

(52) U.S. Cl.
CPC .... *B05B 11/00412* (2018.08); *B05B 11/3047* (2013.01); *B05B 15/37* (2018.02); *A45D 2034/007* (2013.01); *A45D 2200/053* (2013.01)

(58) Field of Classification Search
CPC .. B05B 11/0097; B05B 11/3047; B05B 15/37
See application file for complete search history.

(56) References Cited

FOREIGN PATENT DOCUMENTS

| | | | |
|---|---|---|---|
| WO | 2011/096257 | A1 | 8/2011 |
| WO | 2015/178917 | A1 | 11/2015 |

OTHER PUBLICATIONS

Written opinion for PCT/FR2020/050121 dated Oct. 20, 2020.
International search report for PCT/FR2020/050121 dated Oct. 20, 2020.
International Preliminary Report on Patentability dated Feb. 9, 2021 from the European Patent Office English in Application No. PCT/FR2020/050121 Translation.

FLUID PRODUCT RESERVOIR

CROSS-REFERENCE TO RELATED APPLICATIONS

This application is a National Stage of International Application No. PCT/FR2020/050121 filed Jan. 27, 2020, which claims priority under U.S.C. § 119(a) to French Patent Application No. FR1900745 filed on Jan. 28, 2019.

The present invention relates to a fluid reservoir comprising a body and a neck defining an opening, the neck comprising an upper annular edge defining an outer ridge and an inner ridge, the opening being defined by an inner wall connected to the upper annular edge by the inner ridge. Such a reservoir is commonly used in the fields of perfumery and cosmetics. It is generally associated with a pump or a valve for extracting the fluid that it contains. A single or extended plug of a rod may also be mounted on the neck to close it.

In the prior art, it is known to provide such a reservoir with an interior decorative piece or also with a flexible pouch.

Document FR2776627 describes, for example, a dispenser comprising a fixing sleeve which rests on the upper annular edge of the neck of a reservoir and which serves as a support for a decorative element which extends around the dip tube of a pump mounted on the neck of the reservoir. The fixing sleeve has a perfectly symmetrical configuration, just like the neck of the reservoir. It follows that the decorative element is arranged without precise angular orientation inside the reservoir. This device would not be suitable for inserting a deployment decoration requiring a precise initial angular orientation before insertion in order to deploy correctly in the particular internal geometry of a reservoir. Indeed, such a non-oriented decoration can lead to blocking or friction along the internal walls, preventing the complete deployment of the decoration.

The same applies for an internal flexible pouch.

The flexible pouches are generally provided with a support sleeve which is arranged in and on the neck of the reservoir. The angular orientation of the flexible pouch in the reservoir is often imposed by its geometry and that of the reservoir. More specifically, when the reservoir has a rectangular or oblong cross-section, the flexible pouch is sized in a corresponding manner, such that its deployment in the reservoir causes it to rotate such that it can occupy as much space as possible. Otherwise, the flexible pouch does not have any particular angular orientation in the reservoir.

The present invention aims to define a reservoir that makes it possible to fix the angular orientation of a decorative element or of a flexible pouch and more generally to position a decorative element or a flexible pouch in the three dimensions of the space x, y and z with respect to the reservoir.

To do this, the present invention proposes that the upper annular edge of the neck is provided or formed with at least one cutout that extends on the inner wall, interrupting the inner ridge. Said at least one cutout does not extend to the outer ridge, thus leaving the upper annular edge uninterrupted. In addition, it forms a base defining a ridge with the inner wall of the opening. Preferably, two diametrically opposed cutouts are provided.

As a result, the cutouts extend only over a portion of the inner periphery of the upper annular edge, thus forming two hollow notches separated by two intact annular edge segments. These cutouts can also be described as cavities, alcoves, housings, cuts, recesses, indentations, grooves, etc.

The ends of each cutout form stop profiles in rotation and the base forms an axial bearing surface. Any member occupying such a cutout is thus prevented from rotating x and y by the ends of the cutout, and in the height z by the base of the cutout. This locking characteristic on the neck in rotation x, y and in the height z is essential if it is sought to fill through the insert without causing it to rotate or sink into the reservoir. It is also essential if it is sought to insert into the reservoir a member requiring deployment oriented and indexed at x, y and z with respect to the neck and the internal shape of the reservoir.

According to the invention, the fluid reservoir further comprises an insert engaged in the neck and comprising a fixing sleeve disposed in the neck, this fixing sleeve comprising at least one flange section which projects radially outwards and which is received in said at least one cutout of the neck while resting on its base (151). The insert may comprise a decorative element or also a flexible pouch. Advantageously, the flange section is received substantially without any clearance in rotation in its respective cutout. In other words, the flange section extends from one end of each cutout to the other or comes into contact with the two opposite ends of the cutout. At each flange section, there remains an annular edge area, such that the annular edge forms a complete loop, the width of which is tapered at the cutouts.

According to another aspect of the invention, the fixing sleeve may be pierced with at least one vent hole, which allows the air contained in the reservoir around the fixing sleeve to be evacuated outwards. Indeed, the reservoir is filled with fluid product, while the insert is already in place in the reservoir. The fluid product is injected through the fixing sleeve and when the level of fluid product in the reservoir reaches the bottom of the sleeve, it is necessary for the air trapped in the reservoir to be able to exit it. However, since the sleeve is in place in the neck of the reservoir, it prevents the evacuation. Hence, the presence of one or two vent holes which will cause the reservoir to communicate with the neck by passing through the sleeve. In a variant or complementarily, the fixing sleeve may comprise two opposite flat spots between the flange sections. These flat spots make it possible to create passages between the neck and the sleeve, which allow the air trapped in the reservoir to escape outwards. Thus, it is possible to produce a sleeve with vent holes and/or flat spots.

Given that the insert is force-fitted through the neck, it is advantageous for it to be provided with vertical reinforcing ribs at the neck. These ribs may be made of one piece with the sleeve or also by overmoulding or bi-injection. These ribs may also contribute to the evacuation of the air at the time of filling the bottle. For example, it is possible not to completely depress the sleeve into the neck during the filling.

According to a particular embodiment, the fixing sleeve may be provided with a decorative element that has a span greater than the diameter of the inner wall of the neck. Thus, the decorative element is deformed during its passage through the neck and then unfolds in the body of the reservoir. With a reservoir that is not of revolution, it is preferable, even necessary, for the decorative element to be oriented correctly inside the reservoir. According to another embodiment, a flexible pouch may be integral with the fixing sleeve, which thus serves as a pouch support.

The invention also defines a fluid product dispenser comprising a fluid product reservoir as defined above and a dispenser member, such as a pump, mounted in a leaktight manner on the upper annular edge of the neck.

The scope of the invention resides in locally profiling the inner part of the upper annular edge of the neck of the reservoir to form rotating stop profiles. The insert which engages with the cutouts of the neck is not only oriented in rotation, but also accurately positioned in height inside the reservoir.

The invention is described more fully below, with reference to the accompanying drawings which show two embodiments of the invention by way of non-limiting examples.

Figure 2:
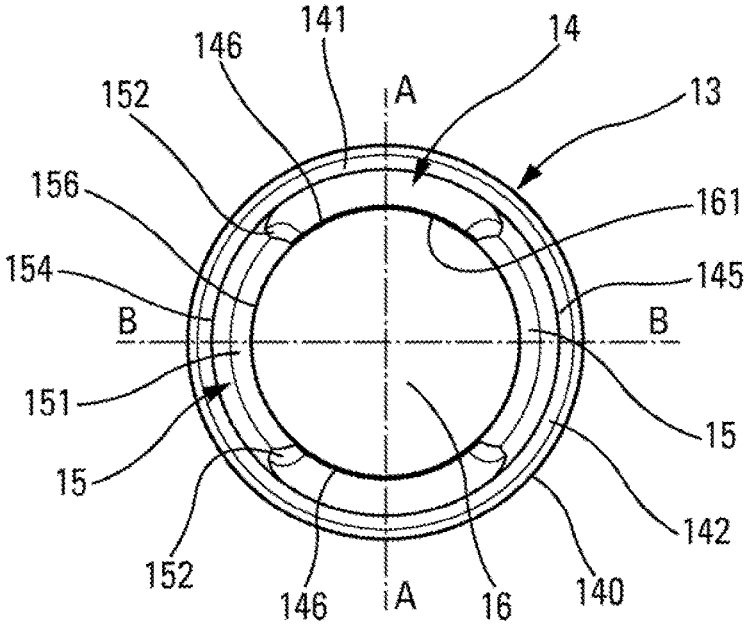
Figure 3A:
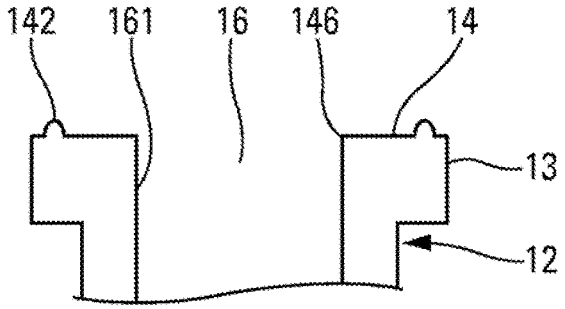
Figure 3B:
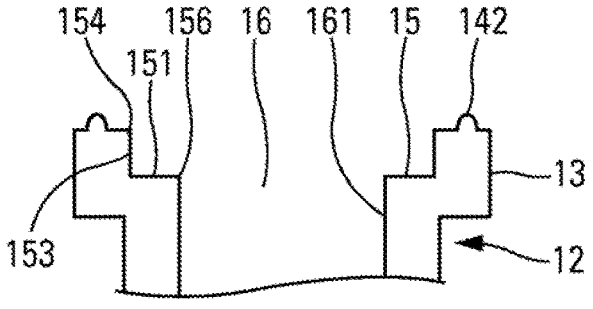
Figure 4:
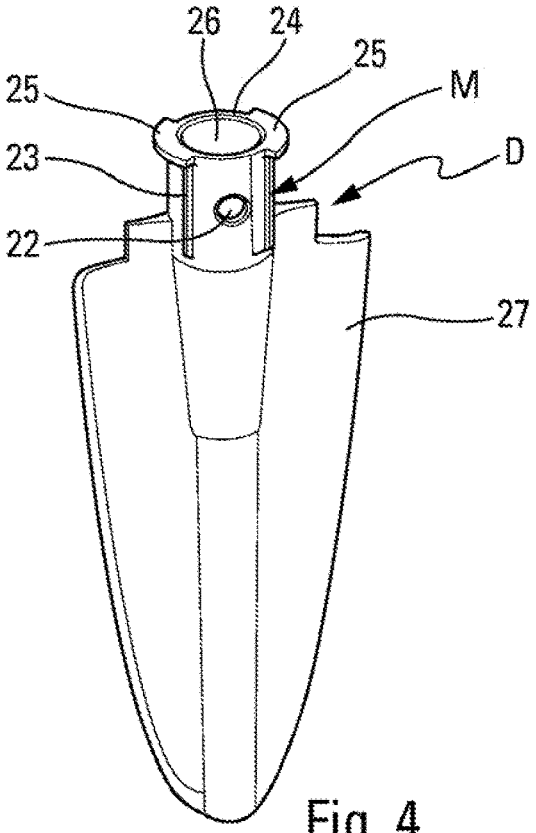
Figure 5:
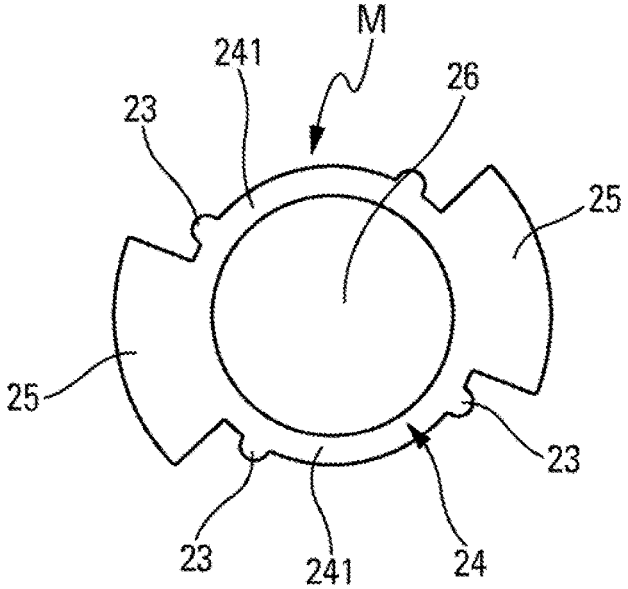
Figure 7:
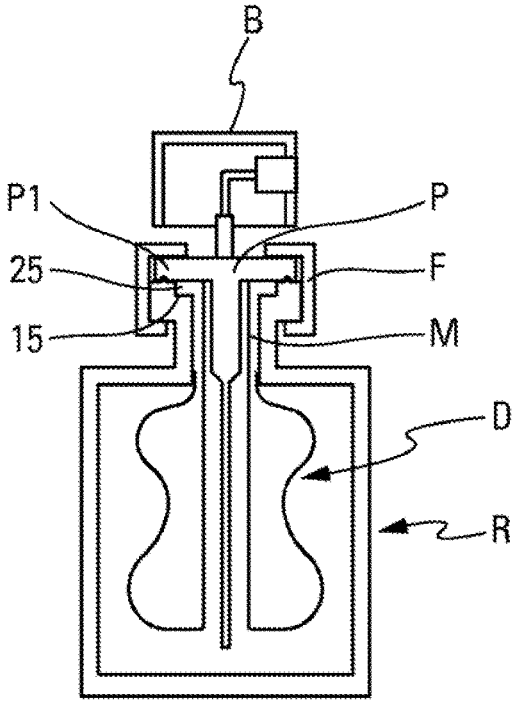
Figure 6:
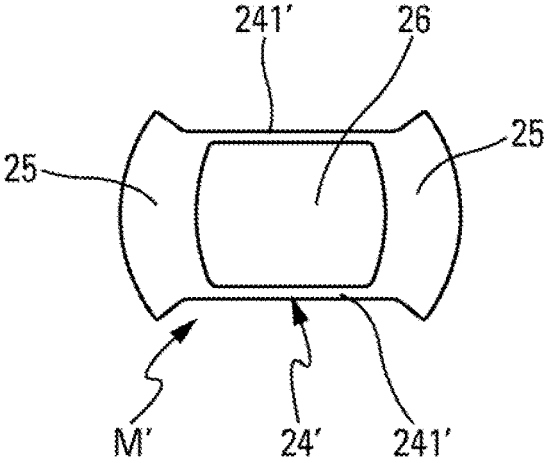
Figure 8:
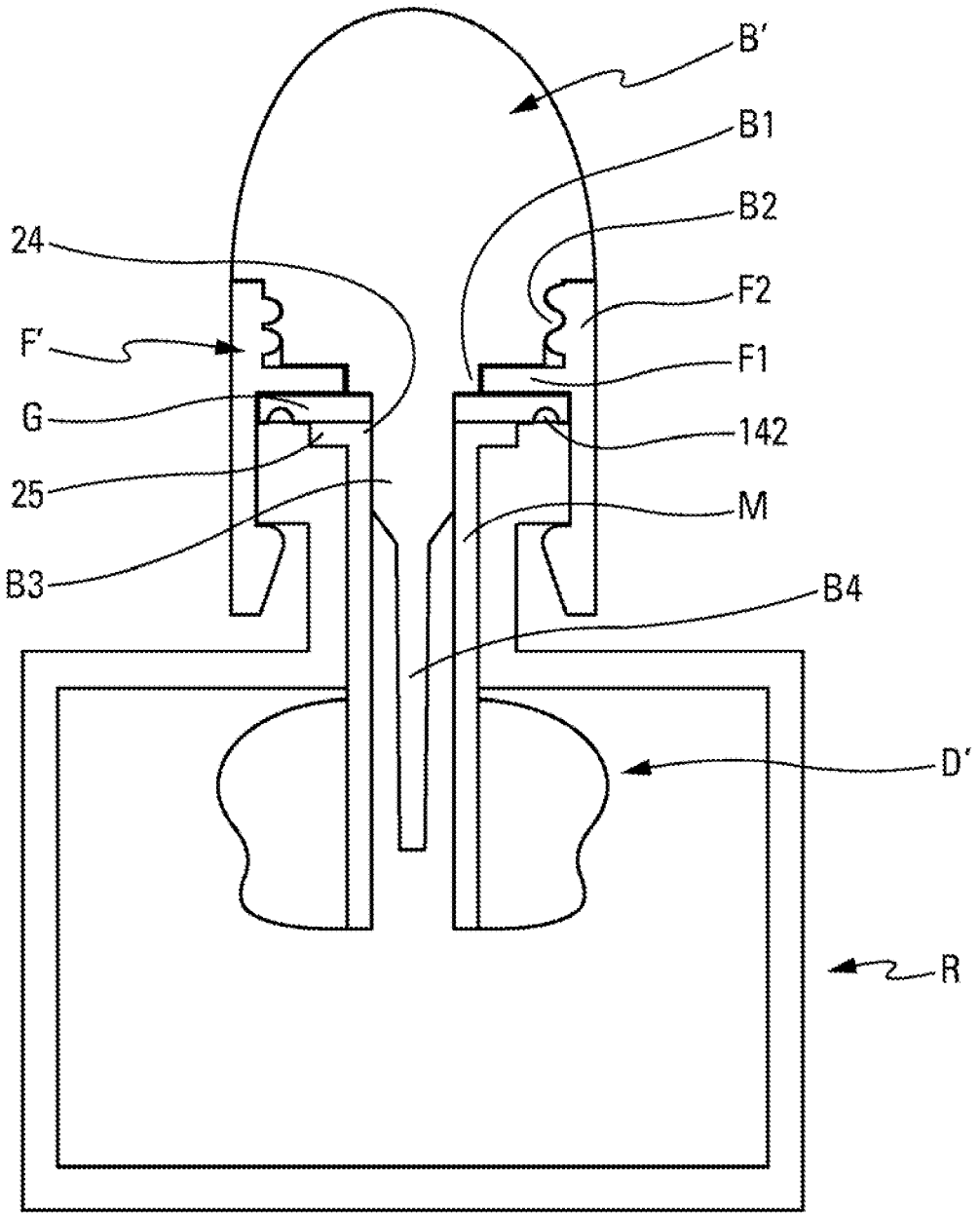
Figure 9:
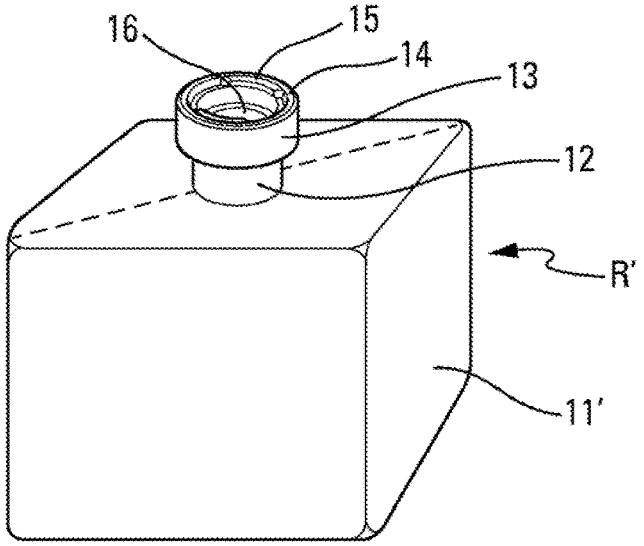
Figure 10:
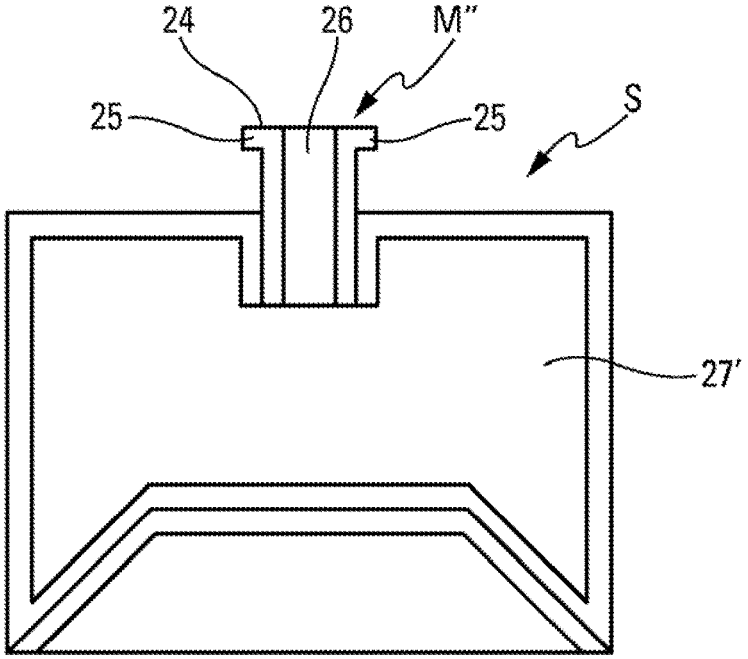
Figure 11:
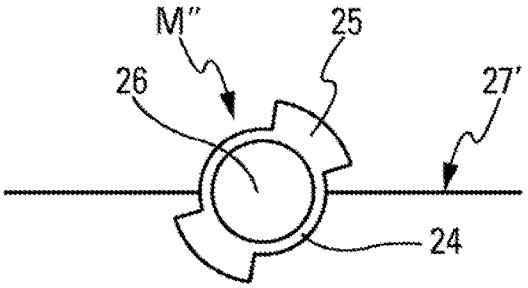

In the figures:

FIG. 1 is a schematic, perspective view of a fluid product reservoir according to a first embodiment of the invention, FIG. 2 is a top view of the neck of the reservoir of FIG. 1, FIGS. 3A and 3B are vertical cross-sectional views of the neck of FIG. 2, respectively along section lines AA and BB of FIG. 2, FIG. 4 is a schematic, perspective view of an insert according to a first embodiment of the invention, FIG. 5 is a top view of the sleeve of the insert of FIG. 4, FIG. 6 is a view similar to FIG. 5 for an embodiment variant, FIG. 7 is a vertical cross-sectional view through a fluid product dispenser integrating a pump, a reservoir and an insert according to the invention, FIG. 8 is a view similar to that of FIG. 7 with a stop instead of the pump, FIG. 9 is a view similar to FIG. 1 for a reservoir according to a second embodiment of the invention, FIG. 10 is a vertical cross-sectional view through an insert according to a second embodiment of the invention, and FIG. 11 is a top view of the insert of FIG. 9, FIG. 1 shows a fluid product reservoir R comprising a body 11 forming a fluid product storage volume and a neck 12 that extends upwards from the body 11 and that defines an opening 16 that makes the inside of the body 11 communicate with the outside. The body 11 and the neck 11 can be made of one piece or made of two separate assembled parts. The neck 12 may comprise a projecting annular reinforcement 13 which will serve for fixing a dispenser member, such as a pump, by means of a fixing ring. With reference to FIGS. 2, 3A and 3B, it can be seen that the neck 12 defines an upper annular edge 14, which may be perfectly flat. Preferably, this annular edge 14 comprises a projecting annular sealing ring 142. On the other hand, an outer edge 140 is formed at the junction of this edge 14 with the annular reinforcement 13. Inside, the opening 16 forms an inner wall 161 which is connected to the edge 14 by forming an inner edge 146. According to the invention, the annular edge 14 and the inner wall 161 are interrupted by two cutouts 15, which thus interrupt the inner ridge 146. These two cutouts 15 do not extend as far as the outer ridge 140, such that two annular edge areas 145 remain at the cutouts 15. More specifically, each cutout 15 extends on a part of the periphery of the edge 14, for example over 60°. Each cutout defines two opposite ends 152, as well as a base 151 and a vertical wall 154. The base 151 defines a ridge 156 with the inner wall 161 of the opening 16. The vertical side wall 153 defines a ridge 154 with the edge area 145. Each cutout 15 may have a configuration that is generally dovetail-shaped. The base 151 is flat, while the vertical wall 153 is curved. The two ends 152 may be flat and extend radially. The two edge areas 145 are connected together via two edge sections 141 having a greater width. In other words, it can be said that the cutouts 15 are hollowed out in the upper annular edge 14 towards the opening 16, leaving the annular reinforcement 13 intact. It must be noted that the annular edge 14 extends over the entire periphery, including at the cutouts 15, thus forming a closed flat loop. The sealing ring 142 is also continuous over the entire periphery.

In the example used, the neck forms two cutouts 15. However, without moving away from the scope of the invention, it is possible to make a neck with only one cutout, or on the contrary, with more than two cutouts. Preferably, the cutout(s) extend(s) only inwards. However, in certain cases, it may be considered to extend the cutouts 15 as far as the outer ridge 140. The base 151 of the cutouts is flat, but it is also possible to make it with another configuration. The vertical side walls 154 are curved, but it is also possible to consider making them with another configuration, in particular rectilinear planes. An essential characteristic of the cutouts resides in the fact that they are hollowed out in the annular edge 14 and open towards the opening 16.

The reservoir R can be made of any appropriate material, like for example glass, wood, ceramics, plastic material or also metal. The shape of the body 11 and of the neck 12 is not critical for the present invention, insofar as the upper annular edge 14 is formed with one or more cutouts such as described above According to the invention, the reservoir R is provided with an insert D, as can be seen in FIG. 4. This insert D is intended to be engaged in the neck 12 of the reservoir R so as also to extend inside the body 11. The insert D of FIG. 4 comprises a fixing sleeve M, which has a generally tubular shape. The insert D also comprises a decorative element 27 which may be made integrally with the sleeve M. In a variant, it is also possible for the decorative element 27 to be attached to and fixed to the sleeve M. According to one manufacturing technique, the decorative element 27 may be made by overmoulding or by bi-injection moulding, in particular with a plastic material which is more flexible than that of the sleeve M. With reference to FIG. 4, it can be seen that the decorative element 27 is here in the form of two wings which extend on either side of the sleeve M. The span of these two wings is much greater than the diameter of the opening 16 in the neck 12. However, due to the deformability of the decorative element 27, it is possible to engage the sleeve M inside through the neck 12 by deforming the decorative element 27. Once the neck 12 has been passed, the decorative element 27 can be deployed and extend freely inside the reservoir R. Of course, it is preferable in this case for the reservoir R to be made of a transparent material, such as glass.

With reference to the upper part of FIG. 4 or also to FIG. 5, it can be seen that the upper part of the sleeve M is made with one or more vent holes 22, which pass through the wall thickness of the sleeve M. The vent hole 22, which can be seen in FIG. 4, extends as far as the inside of the sleeve M. It is thus possible to provide one or more vent holes 22, for example distributed equidistantly all around the periphery of the sleeve M. It can also be noted that the outer wall of the sleeve M is provided with several vertical reinforcing ribs 23 which project outwards, as can be seen in FIG. 5. These ribs 23 may be made in one piece with the sleeve M, or, on the contrary, they may be overmoulded or bi-injected, for example with a particularly rigid plastic material. The aim of these ribs 23 is to reinforce the strength of the sleeve M, in particular when a vertical thrust is exerted. These ribs 23 also make it possible to keep the vent holes 22 out of contact with the inner wall 161. These ribs 23 may also serve, in certain cases, to hold the sleeve in place in the neck by friction. They can therefore fulfil three functions: reinforcement, venting and holding.

At its top end, the sleeve M defines an annular edge 24 that delimits an opening 26 that extends through the sleeve M and communicates with the vent hole 22. The annular edge 24 also forms two flange sections 25 that project radially outwards. It can be noted that these flanges 25 have a dovetail-shaped configuration, just like those of the recesses 15 in the neck 12 of the reservoir R. These flange sections 25 can be sized so as to be able to be received in the cutouts 15. Preferably, each flange section 25 completely fills its respective cutout 15. This means that the two opposite edges of the flange sections 25 will simultaneously come into contact with the two opposite ends 152 of the cutout 15. Thus, the flange sections 25 are received without any clearance in rotation inside the cutouts 15. The lower surface of the flange sections 25 comes to bear against the base 151 of the cutouts 15. The upper surface of the flange sections 25 can advantageously come flush with the annular upper edge 14 of the neck 12. The reinforcing ribs 23 may come into contact with the inner wall 161 of the opening 16 of the neck 12. The vent hole 22 is preferably kept away from the inner wall 161 so as not to be obstructed. In the embodiment of FIG. 5, the two flange sections 25 are connected together by two curved wall sections 241, since the sleeve M has a circular cylindrical configuration.

In the variant embodiment of FIG. 6, the sleeve M' still has a cylindrical, but non-circular, cross-section. Indeed, it can be seen that the two flange sections 25 are connected together by two flat spots 241'. The annular edge 24' is thus no longer circular, but rather rectangular in shape. In this embodiment variant, it may not be necessary to form vent holes 22 in the flat spots 241', nor ribs 23. Indeed, given that the inner wall 161 of the opening 16 is substantially or perfectly circular cylindrical and that the flat spots 241' are by definition flat, there remains a passage between the inner wall 161 and the flat spots 241. This passage is much smaller in the embodiment of FIG. 5, given that the connecting sections 241 are curved, just like the inner wall 161. The spacing between the connecting sections 241 and the inner wall 161 is ensured by the ribs 23.

FIG. 7 very schematically shows a dispenser incorporating the reservoir R of the invention and the insert D of the invention. The dispenser also comprises a dispenser member P which may be a pump. This dispenser member P is provided with a pushbutton B which makes it possible to actuate the pump and to dispense the fluid, for example in the form of a spray. In order to fix the pump P on the neck 12 of the reservoir R, a fixing ring F is provided, which may be a crimpable, screwable or snap-fittable ring. The aim is to maintain the dispensing member P in a fixed and leaktight manner on the neck 12. It can be noted in FIG. 7 that the flange sections 25 are engaged inside the cutouts 15 and that the dispensing member P comprises a flange P1 which comes into leaktight contact with the annular edge 14 of the neck, possibly with a neck gasket interposed therebetween. The sealing is preferably carried out at the sealing ring 142. The body of the dispensing member P extends inside the fixing sleeve M of the insert D.

To assemble this dispenser, the procedure is as follows. The insert D is first engaged in the reservoir R through the neck 12. To do this, the lower end of the insert D is presented at the opening 16. By pressing the insert D against the reservoir R, the decorative element 27 will deform, for example by winding around the sleeve M. This makes it possible to engage the decorative element 27 and the sleeve M in the opening 16 of the neck 12. For this purpose, the upper annular edge 24 of the sleeve M is pressed strongly, hence the usefulness of the reinforcing ribs 23. The forcible insertion of the insert D through the neck 12 continues until the decorative element 27 reaches below the neck 12, inside the body 11, where it can then be deployed freely. The final phase of positioning the insert D in the reservoir R consists of positioning the flange sections 25 in alignment with the cutouts 15, so as to be able to receive them. A final axial bearing on the annular edge 24 makes it possible to engage the flange sections 25 inside the cutouts 15. Not only has the insert D reached its position inside the reservoir R, but above all, the decorative element 27 is perfectly oriented with precision inside the body 11, due to the engagement of the flange sections 25 in the cutouts 15. This makes it possible to orient the decorative element 27 angularly in a precise manner with respect to the reservoir R, most specifically when the latter has a configuration that is not symmetrical about revolution.

The decorate element 27 here has a much greater span than that of the opening 16, but it is also possible to consider another decorative element of which the overall size remains within that of the opening 16 of the neck 12.

It must be noted that the insert D is introduced into the reservoir R while the reservoir R is empty. The reservoir R is filled through the insert D, and more specifically its fixing sleeve M. In practice, an injection cannula is engaged inside the opening 26. This injection cannula injects fluid product into the reservoir through the sleeve M. As soon as the fluid product in the reservoir R reaches the lower end of the sleeve M, the air trapped in the reservoir R must escape therefrom around the sleeve M engaged in the neck. To facilitate the evacuation of the trapped air, one or more vent hole(s) 22 are provided, as mentioned above, which allow the air to be evacuated not only around the sleeve M, but also through the sleeve M. Complementarily or in a variant, the fixing sleeve M', with its flat spots 241', also allows a correct evacuation of the air, by creating two passages of increased cross-section. Thus, it is possible to use a fixing sleeve with flat spots or with vent holes or with both cumulatively.

Once the reservoir has thus been filled, the dispensing member P is deposited on the reservoir R and fixed in place using the fixing ring F. Finally, the pushbutton B is mounted on the actuator rod of the dispensing member P. A protective cap, not shown, may be mounted to protect the pushbutton B.

In a variant, the insert D may be held in place on the neck by means of a ring on which a simple plug may be mounted. FIG. 8 shows a more advanced embodiment, implementing a plug B' which engages with a fixing ring F', a neck gasket G and the sleeve M of an insert D'. More specifically, the insert D' can be similar to the insert D: it may possibly be shorter, but its sleeve M remains unchanged overall. Its flange sections 25 are engaged in the cutouts. The neck gasket G is positioned on the sealing ring 142 of the neck, the flange sections 25 and the annular edge 24. The inner periphery of the neck gasket G can come into alignment with the inner wall of the sleeve M. The fixing ring F' is engaged with the neck and comprises an inner flange F1 which extends above the neck gasket G in order to compress it against the sealing ring 142 of the neck, the flange sections 25 and the annular edge 24, in order to create a seal. The fixing ring F' also comprises a bushing F2 which is internally threaded. The plug B', which may be in one piece or in several parts, comprises a threaded ring B2 which comes into threaded engagement with the threaded bushing F2. The plug B' also comprises a shoulder B1 which bears against the inner edge of the neck seal G in order to compress it against the annular edge 24 of the sleeve M. The plug B' also forms a nipple B3 engaged in the sleeve M so as to create leaktight contact with the inner wall of the sleeve and/or with the neck seal G. Finally, the nipple B3 is extended by a rod B4 which will serve as a fluid product applicator. The rod B4 extends into the sleeve M, and possibly beyond it inside the reservoir R.

The fixing of the plug B' by threading on the fixing ring F' is optional: the plug B' could be held entirely by the engagement by leaktight friction of the nipple B3 and the sleeve M.

Reference is made below to FIGS. 9 to 11 in order to describe a second embodiment of the invention. The fluid product reservoir R' of FIG. 9 is substantially identical to that of FIG. 1, except that it has a horizontal cross-section of square or substantially square shape. The neck 12 with its cutouts 15 may be identical to that of the first embodiment, and will therefore not be described in detail. However, the insert S is very different from that of the first embodiment. This insert S also comprises a fixing sleeve M" which may overall have a configuration substantially similar to the upper part of the sleeve M or M'. This fixing sleeve M" comprises an annular edge 24 which delimits a through opening 26. The edge 24 forms two flange sections 25, which may be identical to those of the first embodiment. Instead of the decorative element 27, the insert S comprises a flexible pouch 27', which may be made by welding laminated complex sheets, for example of aluminium and of plastic material. The flexible pouch 27' is welded around the fixing sleeve M", which then serves as a pouch support. In its initial state, the flexible pouch 27' is substantially flat, as can be seen in FIG. 11. Given the square geometry of the reservoir R', there is no longer any orientation or preferred direction, as is the case with a reservoir of rectangular or oblong horizontal section. Thus, it is advantageous, even necessary, to orient the flexible pouch 27 inside the body 11'. This orientation is not done automatically and it is therefore necessary to rotate the flexible pouch 27' inside the body 11', such that its plane is oriented in the diagonal (shown in dotted lines in FIG. 8) of the body 11'. This orientation by rotation can be done visually or roughly by grasping the fixing sleeve M" and rotating it on itself. However, thanks to the invention, it is no longer necessary to search by trial and error for the optimal orientation. Indeed, it suffices to fix the flexible pouch 27' to the sleeve M" with a defined angular orientation, which makes it possible, once the flange sections 25 have been engaged in the cutouts 15, to position the plane of the flexible pouch 27 in alignment with the diagonal of the body 11'. Then, the pouch 27' can be deployed inside the body 11', occupying a maximum space.

It must be noted that the aligned arrangement of the plane of the flexible pouch 27' with the diagonal of the body 11' is a characteristic that can be protected either, i.e. independently of the fact that the fixing sleeve M" is provided with flange sections 25. This characteristic (alignment of the plane and of the diagonal) is particularly advantageous in the case of a reservoir or bottle of square horizontal cross-section.

Whether it is a decorative element or a flexible pouch, the profiled reservoir with its sleeve makes it possible to determine accurately the arrangement, and more specifically the angular orientation, inside a reservoir. Advantageously, this angular orientation, thanks to the cutouts 15 and the flange sections 25, does not disrupt the subsequent mounting of a dispensing member, such as a pump, since the upper annular edge 14 retains its integrity over its entire periphery.

The invention claimed is:

1. A fluid product reservoir (R; R') comprising a body and a neck defining an opening, the neck comprising an upper annular edge defining an outer ridge and an inner ridge, the opening being defined by an inner wall connected to the upper annular edge by the inner ridge, at least one cutout being provided at the upper annular edge, this cutout extending on the inner wall interrupting the inner ridge but does not extend to the outer ridge, such that the upper annular edge is continuous over its entire periphery, including at the cutout, this cutout further forming a base defining a ridge with the inner wall of the opening;

the reservoir further comprising an insert (D; D'; S) engaged in the neck and comprising a fixing sleeve (M; M'; M") disposed in the neck, this fixing sleeve (M; M'; M") comprising at least one flange section which projects radially outwards and which is received in said at least one cutout of the neck while resting on its base, wherein each flange section fills completely its respective cutout.

2. The fluid product reservoir (R' R') according to claim 1, wherein two diametrically opposite cutouts are provided.

3. The fluid product reservoir (R; R') according to claim 1, wherein the flange section is received substantially without rotational clearance in its respective cutout.

4. The fluid product reservoir (R; R') according to claim 1, wherein the fixing sleeve (M) is pierced with at least one vent hole.

5. The fluid product reservoir (R; R') according to claim 1, wherein the fixing sleeve (M') comprises two opposed flat spots between the flange sections.

6. The fluid product reservoir (R; R') according to claim 1, wherein the fixing sleeve (M) comprises vertical reinforcing and venting ribs at the neck.

7. The fluid product reservoir (R; R') according to claim 1, wherein the fixing sleeve (M; M') is provided with a decorative element that has a span greater than the diameter of the inner wall of the neck.

8. The fluid product reservoir (R; R') according to claim 1, wherein a flexible pouch is integral with the fixing sleeve (M").

9. A fluid product dispenser comprising a fluid reservoir (R; R') according to claim 1 and a dispensing member (P; B'), such as a pump or a plug, mounted in leaktight manner on the upper annular edge of the neck.

* * * * *